US006484983B1

(12) United States Patent
Combest

(10) Patent No.: US 6,484,983 B1
(45) Date of Patent: Nov. 26, 2002

(54) SPEAKER MOUNTING DEVICE

(75) Inventor: Christopher E. Combest, Leawood, KS (US)

(73) Assignee: Multi Service Corporation, Overland Park, KS (US)

( * ) Notice: Subject to any disclaimer, the term of this patent is extended or adjusted under 35 U.S.C. 154(b) by 0 days.

(21) Appl. No.: 09/904,711

(22) Filed: Jul. 13, 2001

(51) Int. Cl.[7] ..... A47B 96/06

(52) U.S. Cl. ..... 248/220.1; 248/220.21; 248/224.8; 312/245; 312/238

(58) Field of Search ..... 248/220.1, 220.21, 248/224.8, 317; 312/245, 238

(56) References Cited

U.S. PATENT DOCUMENTS 3,471,656 A * 10/1969 Quigley ..... 379/454
4,217,629 A * 8/1980 Russell ..... 362/147
4,536,995 A * 8/1985 Frederick ..... 248/220.1
5,349,134 A * 9/1994 Russell ..... 174/48
5,373,654 A * 12/1994 Whalen ..... 312/245

FOREIGN PATENT DOCUMENTS

DE 03132250 A1 * 3/1983

* cited by examiner

*Primary Examiner*—Ramon O. Ramirez
*Assistant Examiner*—Deborah M. Brann
(74) *Attorney, Agent, or Firm*—Hovey Williams LLP

(57) ABSTRACT

A mounting device (10) for mounting a speaker enclosure (12) in an elevated position at an intersection of two walls (14,16) or similar surfaces, wherein the device (10) facilitates easily locating supportive wall studs (18,20) underlying wall sheathings 22,24, and the device (10) is adapted to couple with and support the speaker enclosure (12) in such a manner as to allow for removing and replacing the speaker enclosure (12) from or on the device (10) without removing a corner bracket (26,226) component of the device (10) from the wall (14,16).

10 Claims, 5 Drawing Sheets

SPEAKER MOUNTING DEVICE

BACKGROUND OF THE INVENTION

1. Field of the Invention

The present invention relates to a mounting device for mounting a speaker enclosure or cabinet in an elevated position at a vertical or horizontal intersection of two walls, a wall and a ceiling, or similar structures, wherein the device facilitates easily locating supportive studs underlying surface sheathings, and is adapted to couple with and support the speaker enclosure in such a manner as to allow for dismounting and remounting the speaker enclosure from or on the device without dismounting the device itself from the structures.

2. Description of the Prior Art

Those with skill in the art of home audio or theater systems and speaker enclosures or cabinets will appreciate that it is often desirable to mount a speaker enclosure in an elevated position at a vertical or horizontal intersection of two walls, a wall and a ceiling, or similar structures. Unfortunately, a number of problems are encountered when attempting to do so, including difficulty locating studs or similar structures capable of supporting the speaker enclosure and a mounting mechanism, and difficulty and inconvenience in dismounting and remounting the speaker enclosure for maintenance or replacement.

The studs are constructed of wood or metal for supporting the walls, and typically spaced between twelve and twenty-four inches apart depending on a number of factors, including use and load bearing requirements. Each wall is framed with corner studs, such that an intersection of the walls results in first and second perpendicularly-oriented closely spaced or abutting studs. The studs are covered with a sheathing such as, for example, sheet rock or wood paneling. The wall sheathing is typically unsuitable for supporting substantial loads, such as the speaker enclosure, so any such load mounted on the surface must be secured to one or more underlying studs for reliable support. Unfortunately, it will be appreciated, locating the studs hidden beneath the sheathing can be very difficult. Furthermore, fasteners driven into the an improperly located stud may split or otherwise damage the stud and fail to provide the desired support.

Additionally, recent developments in home theater systems have resulted in speaker enclosures that are larger and heavier than those previously used, thereby making the mounting thereof even more difficult. The speaker enclosures have become larger in order to house more complex crossover networks and bigger speaker magnets, which provide improved control over speaker cone movement. Furthermore, speaker enclosures have become heavier due to use of heavier materials from which the speaker enclosures are constructed, with the heavier speaker enclosures providing improved bass response and reduced resonance.

Once properly mounted, it may at some point become necessary to dismount the speaker enclosure for maintenance or replacement, after which the same or a different speaker enclosure must be remounted. Unfortunately, many existing mounting schemes do not allow for convenient dismounting and remounting, and some require that the mounting mechanism itself be dismounted and remounted or that the fasteners be withdrawn and reapplied to the studs. It will be appreciated that either action can result in damage to the sheathing or the studs and may ultimately undermine their supportive qualities and cause structural failure.

Due to the above-identified and other problems and disadvantages in the art, a need exists for an improved speaker mounting mechanism.

SUMMARY OF THE INVENTION

The present invention overcomes the above-identified and other problems and disadvantages in the art to provide a mounting device for mounting a speaker enclosure or cabinet in an elevated position at a vertical or horizontal intersection of two walls, a wall and a ceiling or similar first and second structures, wherein the device facilitates easily locating supportive studs hidden beneath surface sheathings, and is adapted to couple with and support the speaker enclosure in such a manner as to allow for conveniently dismounting and remounting the enclosure from and on the device without dismounting the device itself from the walls.

The preferred mounting device comprises a corner bracket and an upper and a lower mounting plate. The corner bracket presents a substantially triangular cross-section, is made of aluminum, plastic, or a similarly suitable material, and, in a preferred embodiment, presents five surfaces. The first and second surfaces are corner-facing surfaces and intersect each other at an approximate 150° angle. The third and fourth surfaces are wall-facing and intersect the first and second surfaces, respectively, at approximate 150° angles. The fifth surface is speaker-facing and intersects the third and fourth surfaces at approximate 45° angles, thereby completing and closing the substantially triangular corner bracket. The speaker-facing surface is oriented substantially perpendicular to a plane bisecting the intersection of the walls and provides a coupling mechanism whereby the speaker enclosure may be removably coupled with the mounted corner bracket. In a preferred embodiment, the coupling mechanism comprises an upper and a lower elongated slot or groove in the speaker-facing surface and operable to removably receive upper and lower fasteners associated with the upper and the lower mounting plates.

The mounting plates are secured to a rear portion of the speaker enclosure and incorporate or receive the fasteners. The fasteners may be any suitable coupling mechanism, such as, for example, threaded bolts or fixed mounting posts. Various alternative embodiments of both the corner bracket and the mounting plates are possible, a representative sample of which are presented herein.

In operation, the corner bracket is positioned at the intersection of two walls or a wall and a ceiling. Fasteners driven into holes provided in the corner-facing surfaces automatically align with the underlying corner studs, thereby ensuring proper support. The wall-facing surfaces will abut the walls, and cutouts let into the wall-facing surfaces will correspond to holes in the walls wherethrough speaker wires are able to exit the walls, enter the an interior portion of the corner bracket, and connect to the rear portion of the speaker enclosure. The mounting plates will have been attached to the speaker enclosure using wood screws or an equivalent means. Thereafter, the enclosure may be lowered onto the speaker-facing surface of the bracket such that the upper and lower fasteners are securely received within the elongated grooves. The fasteners are then tightened to complete the mounting process. Dismounting the speaker enclosure is easily accomplished by loosening or removing the fasteners and lifting the enclosure from the mounted bracket.

Thus, it will be appreciated that the present invention offers a number of advantages over the prior art, including a mechanism whereby the corner studs are automatically and reliably located. Furthermore, once mounted, the speaker enclosure may be easily dismounted by loosening the bolts and lifting the enclosure from the corner bracket, without having to dismount the corner bracket itself.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
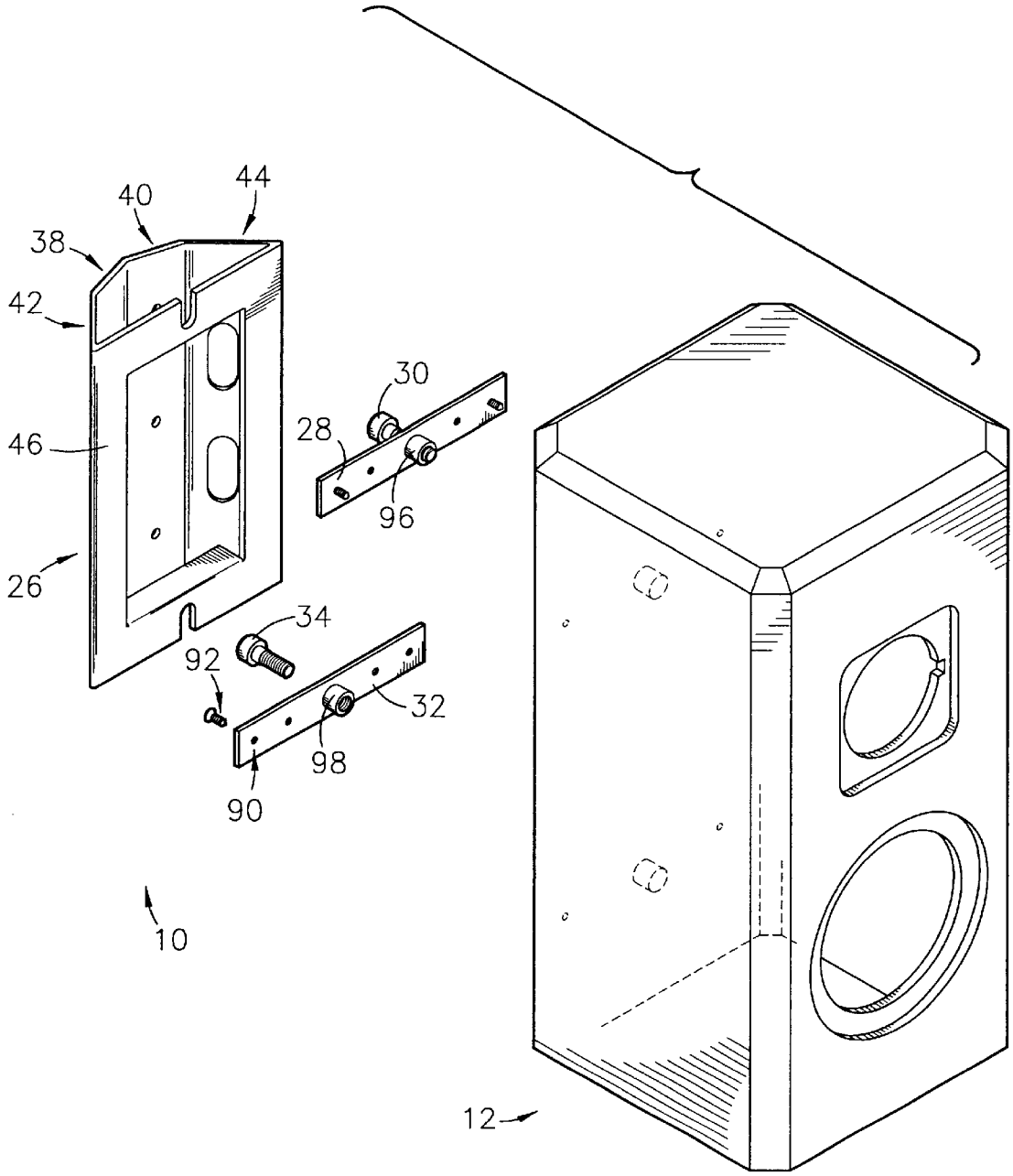
FIG. 1 is an exploded isometric view of a preferred embodiment of the present invention shown in relation to a speaker enclosure.
Figure 2:
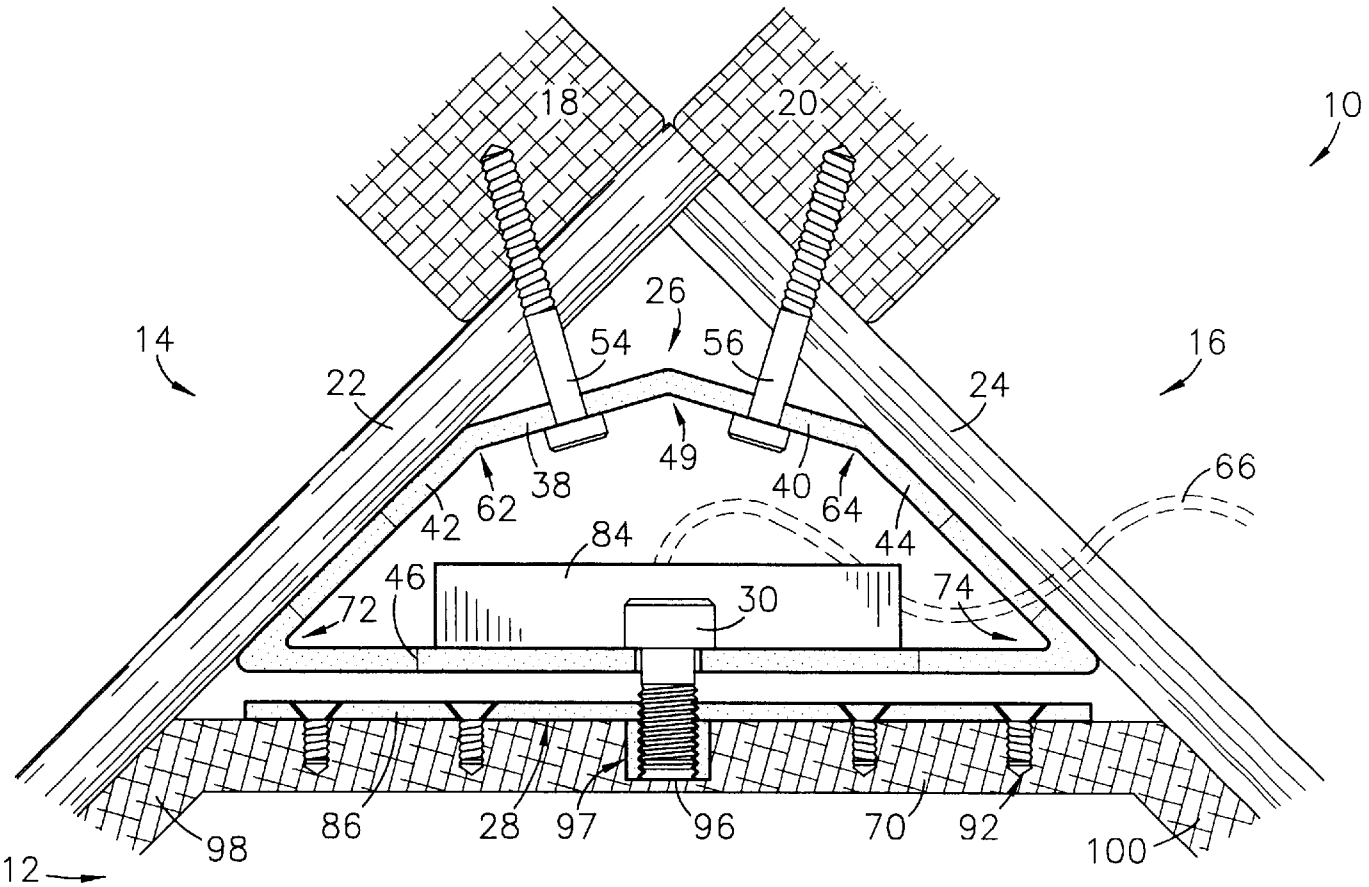
FIG. 2 is a top plan view of a preferred embodiment of the present invention.
Figure 3:
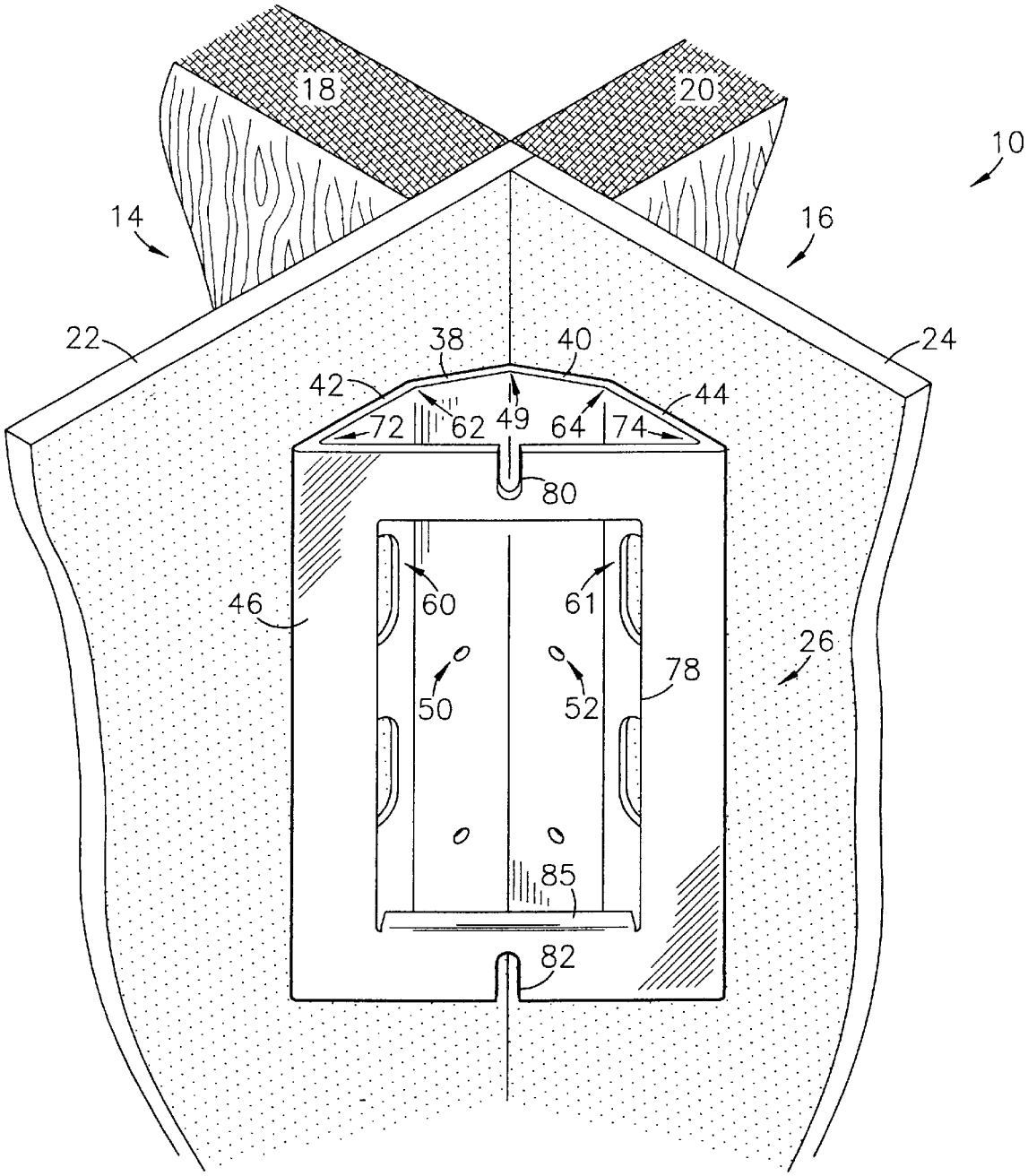
FIG. 3 is a front perspective view of a preferred first embodiment of a corner bracket portion of the present invention.

Referring to FIGS. 1, 2, and 3, a speaker mounting device 10 is shown constructed in accordance with a preferred embodiment of the present invention, and operable to mount a speaker enclosure 12 in an elevated position at an intersection of two walls 14,16, a wall and a ceiling, or similar structures, wherein the device 10 facilitates easily locating supportive wall studs 18,20 underlying wall sheathings 22,24, and the device 10 is adapted to couple with and support the speaker enclosure 12 in such a manner as to allow for dismounting and remounting the speaker enclosure 12 from and on the device 10 without dismounting the device itself from the walls 14,16. The preferred speaker mounting device 10 broadly comprises a corner bracket 26; an upper mounting plate 28, including an upper fastener 30; and a lower mounting plate 32, including a lower fastener 34.

The corner bracket 26 is operable to both facilitate properly engaging the wall studs 18,20 and to couple with and support the speaker enclosure 12 using the upper and lower mounting plates 28,32. The bracket 26 is preferably constructed of 0.125 inch aluminum, though, alternatively, any similarly suitable material maybe used; the bracket's size will depend on the size and weight of the enclosure 12 being mounted, with a larger enclosure 12 requiring a larger bracket 26. The corner bracket 26 presents a number of angled surfaces, including first and second corner-facing surfaces 38,40; first and second wall-facing surfaces 42,44; and a speaker-facing surface 46.

The first and second corner-facing surfaces 38,40 are each substantially identical to the other, being an elongated rectangle providing a plurality of through holes 51,52 spaced approximately 3.25 inches apart. The holes 51,52 allow #10 wood screws 54,56 to pass therethrough, through the wall sheathings 22,24, and into the wall studs 18,20, thereby securing the corner bracket 26. The corner-facing surfaces 38,40 intersect one another at a 150° degree angle 50 such that screwing the wood screws 54,56 into the wall sheathings 22,24 perpendicular to the corner-facing surfaces 38,40 will automatically properly locate and screw into the wall studs 18,20.

The first and second wall-facing surfaces 42,44 are each substantially identical to the other, being an elongated rectangle providing a plurality of spaced apart cutouts 60 each approximately 0.50 inches wide by 1.75 inches long. The cutouts 60 allow easier access for speaker wires 66 exiting the sheathings 22,24. The wall-facing surfaces 42,44 intersect respective corner-facing surfaces 38,40 at a 150° angle 62,64 such that the wall-facing surfaces 42,44 parallel and lay flat against the wall sheathings 22,24 while the corner-facing surfaces 38,40 maintain a proper angle for screwing into the wall studs 18,20.

The speaker-facing surface 46 parallels a rear surface 70 of the speaker enclosure 12, and intersects each wall-facing surface 42,44 at a 45° angle 72,74 such that the speaker-facing surface 46 is perpendicular to a line bisecting the intersection of the two walls 14,16. The speaker-facing surface 46 provides a large center cutout 78 and upper and lower elongated grooves 80,82. The center cutout 78 allows for access to the rear 70 of the speaker enclosure 12, and may be surrounded partially or wholly by flanges 84,86 which provide stiffness to the speaker-facing surface 46 and reduce deflection thereof when tightening the speaker enclosure 12 thereto.

The elongated grooves 80,82 are 0.50–1.00 inches deep and operable to receive the first and second fasteners 30,34. In this embodiment of the corner bracket 26, the grooves 80,82 open in different directions—the upper groove 80 opens upward and the lower groove 82 opens downward. An advantage of this symmetry is that the cornerbracket 26 requires no necessary mounting orientation, thereby eliminating a major cause of improper mounting and subsequent work required to dismount, reorient, and remount the bracket 26.

Figure 4:
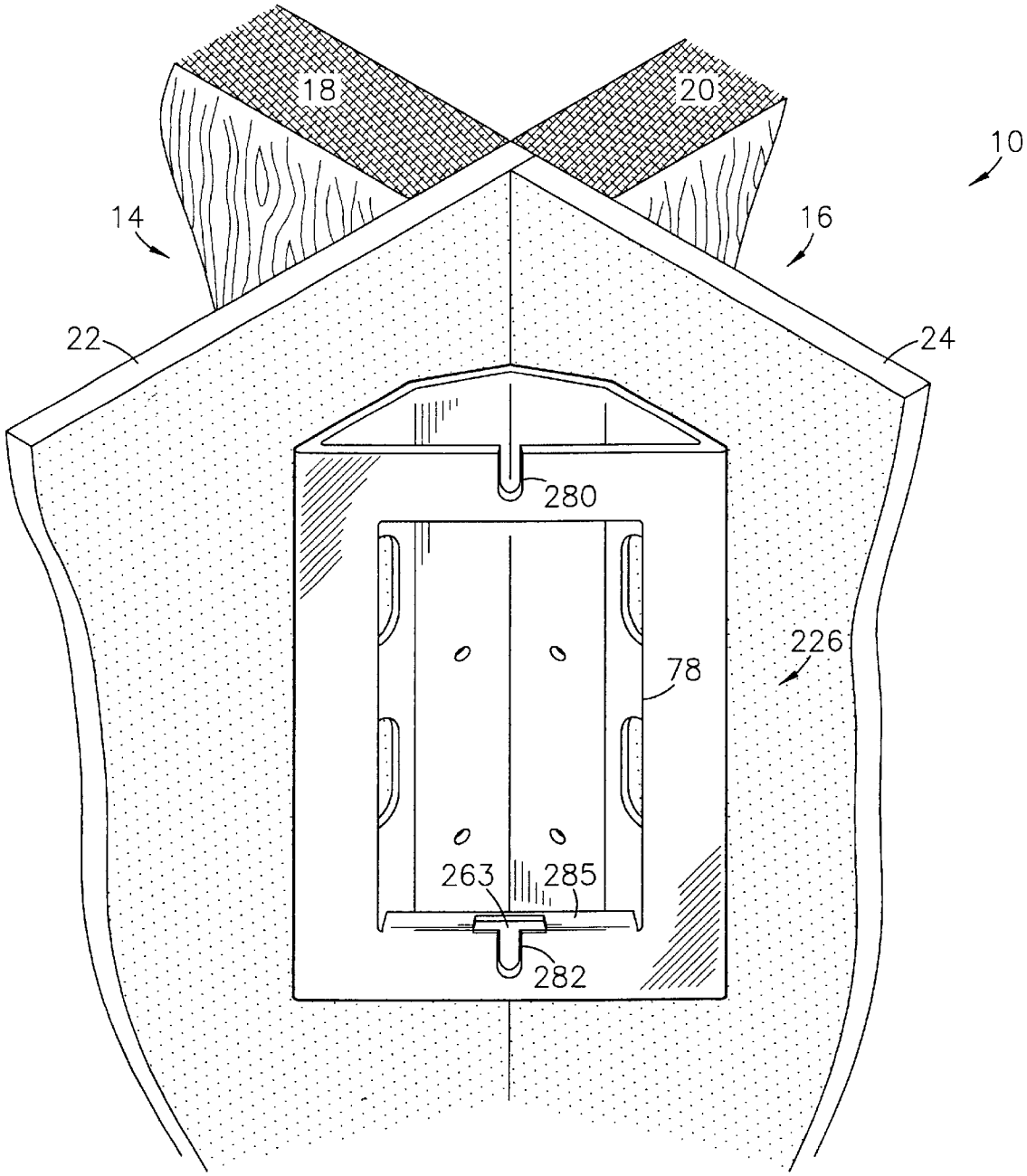
FIG. 4 is a font perspective view of a preferred second embodiment of the corner bracket portion of the present invention.

Referring to FIG. 4, an alternative embodiment of the corner bracket 226 is shown substantially similar to the embodiment 26 described above, but having the upper and lower elongated grooves 280,282 opening in substantially the same direction. A cutout 263 is made in the lower flange 285 to pass the lower fastener 234 when the speaker enclosure is set upon the bracket 226. An advantage of this alternative embodiment 226 is that both fasteners 230,234 can be started and received within the grooves 280,282 when the speaker enclosure is set upon the bracket 226. This is particularly advantageous where the mounting intersection is horizontally oriented, as the two fasteners 230,234 once received within the grooves 280,282 will support the speaker enclosure substantially in its mounted position while the fasteners 230,234 are tightened.

Figure 6:
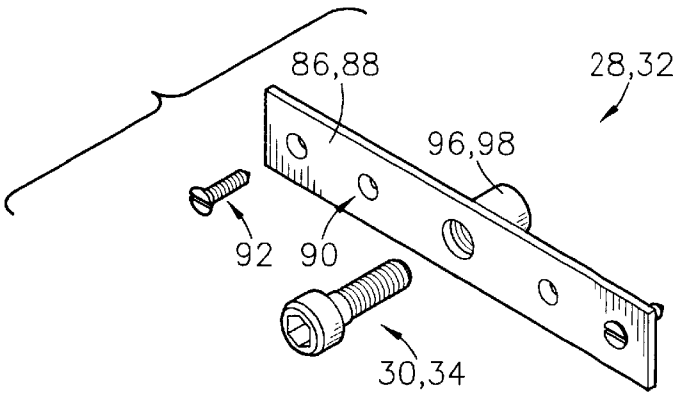
FIG. 6 is an exploded top plan view of the mounting plate portion shown in FIG. 5.
Figure 5:
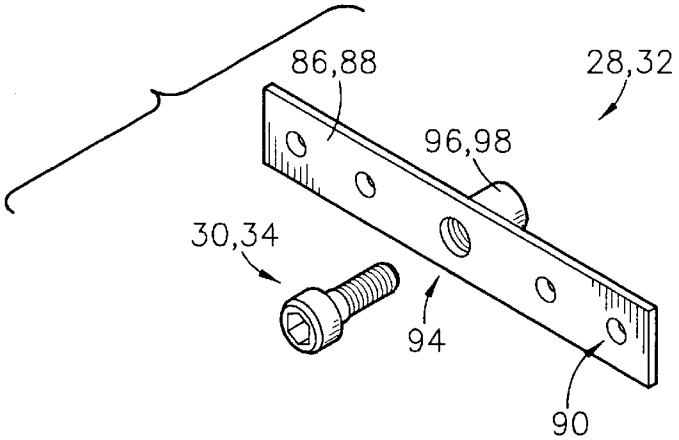
FIG. 5 is an exploded isometric view of a preferred first embodiment of a mounting plate portion of the present invention.

Referring also to FIGS. 5 and 6, the upper and lower mounting plates 28,32 are each operable in cooperation with the first and second fasteners 30,34 to support and retain the speaker enclosure 12 on the mounted corner bracket 26. Each plate 28,32 comprises a substantially flat elongated rectangular piece 86,88, constructed of aluminum or a similarly suitable material able to safely support the speaker enclosure's weight. The rectangular piece 86,88 provides a plurality of screw holes 90 for receiving wood screws 92 for securing the rectangular piece 86,88 to the rear portion 70 of the speaker enclosure 12. Furthermore, projecting perpendicularly from and corresponding to a hole 94 in the center of each rectangular piece 86,88 is an internally threaded sleeve 96 operable to receive the upper and lower fastener 30,34. The sleeve 96 fits into a corresponding hole 97 let into the rear portion 70 of the speaker enclosure 12.

The upper and lower fasteners 30,34 are preferably 1.00 inch long, 0.625 inch diameter threaded bolts operable to screw into the internally threaded sleeves 96 of the mounting plates 28,32, and thereafter to be received within the elongated grooves 80,82 of the speaker-facing surface 46 of the corner bracket 26.

Figure 7:
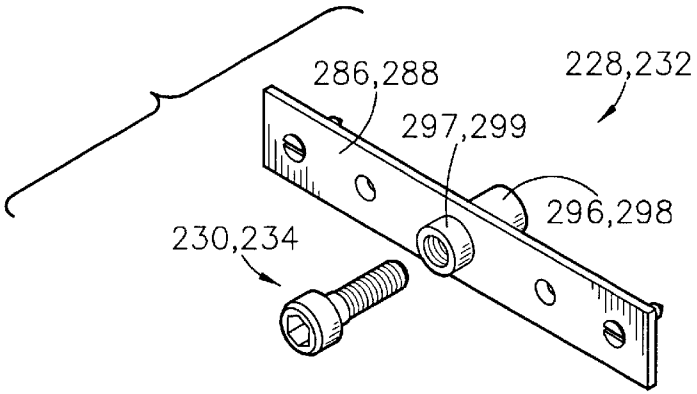
FIG. 7 is an exploded top plan view of a preferred second embodiment of the mounting plate portion of the present invention.

It will be appreciated that numerous variations of the mounting plates 28,32 and fasteners 30,34 exist which are within the scope of the present invention. For example, an alternative embodiment of the mounting plates 228,232 and fasteners 230,234 is shown in FIG. 7, wherein the sleeve 296,298 extends through the rectangular pieces 286,288 to present a sufficient portion 297,299 of the sleeve 296,298 so as to ensure a particular desired spacing between the rectangular pieces 286,288 and the speaker-facing surface 46 of the corner bracket 26. Alternatively, this same embodiment, rather than ensuring spacing, may be used to protect the threads of the threaded fasteners 230,234 by allowing the additional sleeve portion 297,299 rather than the fasteners 230,234 to contact and rest within the elongated groove 80,82. This latter embodiment requires that the elongated groove 80,82 be dimensioned to accommodate the wider sleeve portion 297,299.

Figure 8:
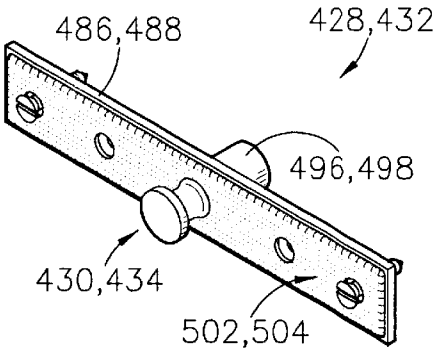
FIG. 8 is a top plan view of a preferred third embodiment of the mounting plate portion of the present invention.

Another alternative embodiment 428,432 is shown in FIG. 8, wherein the fastener is a fixed mounting post 430,434 rather than a threaded bolt. The fixed post 430,434 may be welded or otherwise secured to the rectangular piece 486,488, and is removably receivable within the elongated groove 80,82. Though not adjustable, the fixed post 430,434 operates substantially similar to the threaded bolt embodiment 30,34. Because the post 430,434 cannot be tightened, it may be desirable to coat the rectangular piece 486,488 with a rubber or similar coating 502,504 in order to substantially lessen or eliminate vibrations caused by the operating speaker enclosure 12.

As desired, the speaker enclosure or cabinet may be shaped to further accommodate the walls 12,14 and intersection thereof as shown in FIGS. 1 and 2, wherein the speaker enclosure is provided with beveled surfaces 98,100. Alternatively, the speaker mounting device 10 may be dimensioned to provide sufficient clearance for conventional unbeveled speaker enclosures.

In operation, an installer positions the corner bracket 26 as desired at the intersection of two walls 14,16, with the wall-facing surfaces 42,44 resting flatly against the wall sheathing 22,24. The wood screws 54,56 are then screwed perpendicularly through the screw holes of the corner-facing surfaces 38,40, thereby properly entering into and securely engaging the wall studs 18,20.

Next, both upper and lower mounting plates 28,32 are attached to the rear portion 70 of the speaker enclosure 12 by fitting the sleeves 96,98 into the respective corresponding holes 97, and screwing wood screws 92 through the screw holes 90. Using the corner bracket embodiment 26 of FIG. 3 and the mounting plate embodiment 28,32 of FIGS. 5 and 6, the upper threaded fastener 30 is then partially screwed into the upper internally threaded sleeve 96. The enclosure 12 is then lowered onto the mounted corner bracket 26 so that the upper threaded fastener 30 is received within the upper elongated groove 80; then the upper fastener 28 is tightened. The lower threaded fastener 32 is then screwed through the lower elongated groove 82, into the lower sleeve 98, and tightened to complete the mounting procedure. The speaker enclosure 12 may be easily dismounted by removing the lower fastener 34, loosening the upper fastener 30, and lifting the enclosure off the bracket 26.

Alternatively, using the corner bracket embodiment 226 of FIG. 4 and the mounting plate embodiment 428,432 of FIG. 8, the enclosure 12 is mounted on the bracket 226 by lowering the mounting posts 430,434 of the attached rubber-coated mounting plates 428,432 into the upper and lower elongated grooves 80,82, and applying sufficient force to seat the posts 430,434 therein. Dismounting the speaker enclosure 12 is accomplished by applying sufficient upward force to unseat the mounting posts 430,434 from the elongated grooves 80,84 and lifting the enclosure 12 away from the bracket 226.

From the preceding description, it can be seen that the speaker mounting device 10 of the present invention is operable to mount the speaker enclosure 12 in an elevated position at an intersection of two walls 14,16 or similar structures, wherein the device 10 facilitates easily locating the supportive wall studs 18,20, and is adapted to couple with and support the speaker enclosure 12 in such a manner as to allow for removing and replacing the speaker enclosure 12 from or on the device 10 without removing the device itself from the walls 14,16.

Although the invention has been described with reference to the preferred embodiment illustrated in the attached drawings, it is noted that equivalents may be employed and substitutions made herein without departing from the scope of the invention as recited in the claims. For example, as noted, a variety of mounting plate and fastener configurations may be devised and used for removably coupling the enclosure 12 with the corner bracket 26. Such alternative configurations are within the scope of the present invention.

Having thus described the preferred embodiment of the invention, what is claimed as new and desired to be protected by LETTERS PATENT includes the following:

1. A mounting device for mounting an object at the intersection of a first structure and a second structure, wherein each structure is supported by a corner stud, the mounting device comprising:

a corner bracket presenting at least three surfaces including an an object-facing surface substantially perpendicular to a plane bisecting the intersection of the first and second structures, and providing a mechanism whereby the object may be coupled with the corner bracket;

a structure-facing surface intersecting an end of the object-facing surface at an approximately 45° angle so as to be approximately parallel to one of the structures; and a corner-facing surface intersecting an end of the structure-facing surface at an approximately 150° angle and providing a hole such that a fastener inserted into the hole perpendicular to the first corner-facing surface will be aligned with one of the corner studs.

2. The mounting device as set forth in claim 1, wherein the object is a speaker enclosure.

3. The mounting device as set forth in claim 1, wherein the object-facing surface is substantially rectangular with a center cutout for allowing access to a rear portion of the object.

4. The mounting device as set forth in claim 1, wherein the structure-facing surface is substantially rectangular with a cutout corresponding to a hole in one of the structures and providing access therethrough to an interior area of the corner bracket and to a rear portion of the object.

5. A mounting device for mounting an object at the intersection of a first structure and a second structure, wherein the structures are supported, respectively, by a first corner stud and a second corner stud, the mounting device comprising:

a corner bracket having a substantially triangular cross-section presenting at least three surfaces including a first corner-facing surface securable to the first corner stud, a second corner-facing surface securable to the second corner stud, and an object-facing surface substantially perpendicular to a plane bisecting the intersection of the first and second structures, and providing an elongated groove; and a mounting plate securable to the object and providing a fastening mechanism, wherein the fastening mechanism comprises a threaded sleeve and a threaded fastener, the threaded fastener being screwed into the threaded sleeve and received within the elongated groove to thereby couple the mounting plate and the object secured thereto with the corner bracket.

6. A mounting device for mounting an object at the intersection of a first structure and a second structure, wherein the structures are supported, respectively, by a first corner stud and a second corner stud, the mounting device comprising:

a corner bracket having a substantially triangular cross-section presenting at least three surfaces including a first corner-facing surface securable to the first corner stud, a second corner-facing surface securable to the second corner stud, and an object-facing surface substantially perpendicular to a plane bisecting the intersection of the first and second structures, and providing an upper elongated groove and a lower elongated groove, wherein said upper elongated groove opens in a first direction, and said lower elongated groove opens in a second direction which is opposite the first direction; and a mounting plate securable to the object and providing a fastening mechanism, wherein the fastening mechanism is operable to be received within the elongated groove to thereby couple the mounting plate and the object secured thereto with the corner bracket.

7. A mounting device for mounting an object at the intersection of a first structure and a second structure, wherein the structures are supported, respectively, by a first corner stud and a second corner stud, the mounting device comprising:

a corner bracket having a substantially triangular cross-section presenting at least three surfaces including a first corner-facing surface securable to the first corner stud, a second corner-facing surface securable to the second corner stud, and an object-facing surface substantially perpendicular to a plane bisecting the intersection of the first and second structures wherein the object-facing surface provides an upper elongated groove and a lower elongated groove both opening in the same direction; and a mounting plate securable to the object and providing a fastening mechanism, wherein the fastening mechanism is operable to be received within the elongated groove to thereby couple the mounting plate and the object secured thereto with the corner bracket.

8. A mounting device for mounting a speaker enclosure at the intersection of a first structure and a second structure, wherein the structures are supported, respectively, by a first corner stud and a second corner stud, the mounting device comprising:

a corner bracket having a substantially triangular cross-section presenting at least three surfaces including a first corner-facing surface securable to the first corner stud, a second corner-facing surface securable to the second corner stud, wherein the first and second corner-facing surfaces each provide a hole such that a fastener inserted into the hole perpendicular to the respective surface will be aligned with the respective corner stud, and a speaker-facing surface substantially perpendicular to a plane bisecting the intersection of the first and second structures, and providing a center cutout for allowing access to a rear portion of the speaker enclosure, and also providing an elongated groove; and a mounting plate securable to the rear-portion of the speaker enclosure and providing a fastening mechanism, wherein the fastening mechanism comprises a threaded sleeve and a threaded fastener, the threaded fastener being screwed into the threaded sleeve and received within the elongated groove to thereby removably couple the mounting plate and the speaker enclosure secured thereto with the corner bracket.

9. A mounting device for mounting a speaker enclosure at the intersection of a first structure and a second structure, wherein the structures are supported, respectively, by a first corner stud and a second corner stud, the mounting device comprising:

a corner bracket having a substantially triangular cross-section presenting at least three surfaces including a first corner-facing surface securable to the first corner stud, a second corner-facing surface securable to the second corner stud, wherein the first and second corner-facing surfaces each provide a hole such that a fastener inserted into the hole perpendicular to the respective surface will be aligned with the respective corner stud, and a speaker-facing surface substantially perpendicular to a plane bisecting the intersection of the first and second structures, and providing a center cutout for allowing access to a rear portion of the speaker enclosure, and also providing an upper elongated groove and a lower elongated groove, wherein said upper elongated groove opens in a first direction, and said lower elongated groove opens in a second direction; and a mounting plate securable to the rear-portion of the speaker enclosure and providing a fastening mechanism, wherein the fastening mechanism is operable to be received within the elongated groove to thereby removably couple the mounting plate and the speaker enclosure secured thereto with the corner bracket.

10. A mounting device for mounting a speaker enclosure at the intersection of a first structure and a second structure, wherein the structures are supported, respectively, by a first corner stud and a second corner stud, the mounting device comprising:

a corner bracket having a substantially triangular cross-section presenting at least three surfaces including a first corner-facing surface securable to the first corner stud, a second corner-facing surface securable to the second corner stud, wherein the first and second corner-facing surfaces each provide a hole such that a fastener inserted into the hole perpendicular to the respective surface will be aligned with the respective corner stud, and a speaker-facing surface substantially perpendicular to a plane bisecting the intersection of the first and second structures, and providing a center cutout for allowing access to a rear portion of the speaker enclosure, and also providing an upper elongated groove and a lower elongated groove, wherein said upper elongated groove and said lower elongated groove both open in the same direction; and a mounting plate securable to the rear-portion of the speaker enclosure and providing a fastening mechanism, wherein the fastening mechanism is operable to be received within the elongated groove to thereby removably couple the mounting plate and the speaker enclosure secured thereto with the corner bracket.

* * * * *